US011583857B2

(12) United States Patent
Kassel et al.

(10) Patent No.: US 11,583,857 B2
(45) Date of Patent: Feb. 21, 2023

(54) MICROFLUIDIC DEVICE FOR PROCESSING A LIQUID

(71) Applicant: Robert Bosch GmbH, Stuttgart (DE)

(72) Inventors: Julian Kassel, Pforzheim (DE); Christian Dorrer, Winnenden (DE); Daniel Czurratis, Aalen (DE)

(73) Assignee: Robert Bosch GmbH, Stuttgart (DE)

( * ) Notice: Subject to any disclaimer, the term of this patent is extended or adjusted under 35 U.S.C. 154(b) by 319 days.

(21) Appl. No.: 16/980,131

(22) PCT Filed: Mar. 22, 2019

(86) PCT No.: PCT/EP2019/057256
§ 371 (c)(1),
(2) Date: Sep. 11, 2020

(87) PCT Pub. No.: WO2019/185480
PCT Pub. Date: Oct. 3, 2019

(65) Prior Publication Data

US 2021/0053052 A1 Feb. 25, 2021

(30) Foreign Application Priority Data

Mar. 27, 2018 (DE) ..... 10 2018 204 633.6

(51) Int. Cl.
*B01L 3/00* (2006.01)

(52) U.S. Cl.
CPC ... *B01L 3/50273* (2013.01); *B01L 2400/0481* (2013.01)

(58) Field of Classification Search
CPC ..... B01L 3/50273; B01L 2400/0481
See application file for complete search history.

(56) References Cited

U.S. PATENT DOCUMENTS 9,463,460 B2 10/2016 Kumaran et al.
2002/0039728 A1 4/2002 Kain et al.
(Continued)

FOREIGN PATENT DOCUMENTS

CN 101663097 A 3/2010
CN 102112229 A 6/2011
(Continued)

OTHER PUBLICATIONS

Xiangdong Xue, "Analysis of fluid separation in microfluidic T-channels", Jul. 13, 2011, Applied Mathematical Modelling, 36(2012), 743-755 (Year: 2011).*
(Continued)

*Primary Examiner* — Jennifer Wecker
*Assistant Examiner* — Mickey Huang
(74) *Attorney, Agent, or Firm* — Maginot, Moore & Beck LLP

(57) ABSTRACT

A microfluidic device for processing a liquid in ludci includes at least one pneumatic substrate with a pneumatic cavity and a fluidic substrate with a fluidic cavity for accommodating the liquid. The fluidic cavity is arranged opposite the pneumatic cavity. In addition, the microfluidic device has a flexible membrane which is arranged between the pneumatic substrate and the fluidic substrate. The flexible membrane is designed to fluidically separate, from one another, a fluidic chamber extending at least in part in the fluidic cavity and a pneumatic chamber extending at least in part in the pneumatic cavity. The microfluidic device further includes a first pneumatic channel for applying a first pneumatic pressure to the pneumatic chamber and a second pneumatic channel for applying a second pneumatic pressure to the pneumatic chamber.

14 Claims, 12 Drawing Sheets

(56) References Cited

U.S. PATENT DOCUMENTS

| | | | | |
|---|---|---|---|---|
| 2006/0076068 | A1 | 4/2006 | Young et al. | |
| 2007/0166199 | A1 | 7/2007 | Zhou et al. | |
| 2012/0115189 | A1 | 5/2012 | Jovanovich et al. | |
| 2013/0264205 | A1 | 10/2013 | Hwang et al. | |
| 2014/0056096 | A1* | 2/2014 | Xia | B01F 31/312 366/119 |

FOREIGN PATENT DOCUMENTS

| | | | | |
|---|---|---|---|---|
| CN | 102665915 | A | 9/2012 | |
| CN | 103282706 | A | 9/2013 | |
| EP | 2447352 | B1 | 12/2014 | |
| EP | 2490812 | B1 | 5/2016 | |
| WO | 2007093939 | A1 | 8/2007 | |
| WO | WO-2007093939 | A1 * | 8/2007 | B01F 11/0071 |
| WO | 2010097740 | A1 | 9/2010 | |

OTHER PUBLICATIONS

Ivan C. Christov, "Flow rate-pressure drop relation for deformable shallow microfluidic channels", Feb. 21, 2018, Journal Fluid Mechanics, vol. 841, 267-286 (Year: 2018).*

International Search Report corresponding to PCT Application No. PCT/EP2019/057256, dated Jun. 3, 2019 (German and English language document) (6 pages).

Huang, S.-B. et al., "A pneumatically-driven microfluidic system for size-tunable generation of uniform cell-encapsulating collagen microbeads with the ultrastructure similar to native collagen," Biomed Microdevices, Feb. 5, 2014, vol. 16, 345-354 (10 pages).

* cited by examiner

MICROFLUIDIC DEVICE FOR PROCESSING A LIQUID

This application is a 35 U.S.C. § 371 National Stage Application of PCT/EP2019/057256, filed on Mar. 22, 2019, which claims the benefit of priority to Serial No. DE 10 2018 204 633.6, filed on Mar. 27, 2018 in Germany, the disclosures of which are incorporated herein by reference in their entirety.

BACKGROUND

The disclosure proceeds from a microfluidic device or a method for processing a liquid.

When processing a liquid in a microfluidic device, the flow conditions of the liquid to be processed may be of significance. To influence the flow conditions of the liquid in a microfluidic device, the microfluidic device can be shaped to promote the formation of a particular flow condition.

DE U.S. Pat. No. 9,463,460 describes various geometric embodiments of a microchannel of a microfluidic device that can promote the formation of a turbulent flow from initially two laminar flows when processing a liquid.

SUMMARY

Against this background, what are presented by the approach presented here are a microfluidic device and a method. Advantageous further developments and improvements of the device are possible through the measures discussed herein.

A liquid can advantageously be processed, for example forwarded or mixed, by means of pneumatic pressure. To this end, a microfluidic device comprises a flexible membrane which can be made to move in an oscillating manner by means of pneumatic actuation. As a result of an oscillation of the membrane, liquid can be moved, and it is possible to achieve specifically defined turbulent flow conditions of the liquid to be processed. Depending on the application, the microfluidic device can be used for processing one or more different liquids. The simultaneous processing of multiple liquids can, for example, be utilized for mixing the liquids. For many microfluidic and diagnostic applications, a specific setting of flow conditions of the liquids to be processed is advantageous. In the approach presented here, the setting of the flow conditions can advantageously be effected by means of application of the pneumatic pressure largely independently of geometries of the microfluidic device, and as a result, the microfluidic device and a corresponding method can be used and combined in a versatile manner. Advantageously, the processing of the liquid can thus be effected particularly efficiently. Moreover, air-bubble formation in the liquid to be processed can advantageously be minimized by a specific setting of local and temporal limited turbulent flow conditions of the liquid to be processed by means of the flexible membrane. The processing of the liquid, for example mixing, can, at the same time, advantageously be effected within one cavity, this allowing a compact design. Moreover, the processing of the liquid with a specific setting of laminar and turbulent flows in the same microfluidic cavity may be advantageous for, for example, mixing and precipitating certain blood cells or circulating tumor cells from a liquid patient sample, for example blood, via a buffer and then enriching and separating them in a laminar flow in a gravity-driven manner or by application of a magnetic field.

A microfluidic device for processing at least one liquid is presented. The microfluidic device comprises at least a pneumatics substrate, a fluidics substrate, a flexible membrane, and a first and a second pneumatics channel. The pneumatics substrate comprises a pneumatics cavity. The fluidics substrate comprises a fluidics cavity for accommodating the liquid. The fluidics cavity is arranged opposite to the pneumatics cavity. The flexible membrane is arranged between the pneumatics substrate and the fluidics substrate. The flexible membrane is designed to fluidically separate a fluidics space extending into the fluidics cavity at least in part and a pneumatics space extending into the pneumatics cavity at least in part from one another. The first pneumatics channel is designed for application of a first pneumatic pressure to the pneumatics space and the second pneumatics channel is designed for application of a second pneumatic pressure to the pneumatics space.

The microfluidic device can, for example, be a device for a chip laboratory, also called a lab-on-a-chip system. A chip laboratory can be understood to mean a microfluidic system in which the entire functionality of a macroscopic laboratory can be accommodated on a, for example, credit card-sized plastics substrate of the chip laboratory cartridge and in which complex biological, diagnostic, chemical or physical processes can take place in a miniaturized manner. With the aid of the microfluidic device, it is, for example, possible to provide or transport a liquid on a chip. The liquid to be processed can, for example, be understood to mean a liquid reagent, such as, for example, a salt-containing, ethanol-containing or aqueous solution, or a detergent or dry reagent, such as lyophilisate or salt. By means of a deflection of the flexible membrane, the liquid can be displaced at least in part, or it is, for example, possible to open or close valves. The microfluidic device comprises a pneumatics substrate and a fluidics substrate. To this end, the microfluidic device can have a polymeric multilayer construction consisting of at least two polymer substrates which are, for example, separated by the flexible membrane into a pneumatic and a fluidic plane, the pneumatics substrate and the fluidics substrate. Instead of polymers, it is also possible to use other suitable materials for the substrates. Alternatively, the pneumatics substrate and the fluidics substrate can also be formed as one piece. The flexible membrane can be a polymer membrane, for example a thermoplastic elastomer. The flexible membrane can be designed to oscillate or vibrate in response to the application of a pneumatic pressure for processing of the liquid. As a result of said oscillations, it is advantageously possible to generate turbulent flow conditions in the liquid in the opposite fluidics space. The first or second pneumatic pressure applied via the first or the second pneumatics channel can be a pressure which can be generated by means of a pneumatic pressure medium, for example pressurized air or nitrogen. The first and the second pneumatic pressure can, for example, have the same pressure level or a different pressure level. For example, as a result of the application of the first pneumatic pressure and the second pressure differing from the first pneumatic pressure, it is possible to generate a defined pressure difference in order to make the flexible membrane move in an oscillating or vibrating manner for processing of the liquid.

According to one embodiment, the first pneumatics channel and/or the second pneumatics channel can open into the pneumatics cavity. For example, the first and the second pneumatics channel can open into the pneumatics space of the pneumatics cavity. The first and the second pneumatic pressure can thus be applied particularly effectively, for example by introduction of a fluid pressure medium into the pneumatics cavity in order to make the membrane move in an oscillating manner.

Moreover, the first pneumatics channel and/or the second pneumatics channel can, according to one embodiment, be guided through a cover of the pneumatics cavity that is opposite to the membrane. To this end, the pneumatics cavity can, for example, have a polymeric cover layer as the cover; the cover can, for example, also be part of the pneumatics substrate. The cover can be shaped to microfluidically close the pneumatics cavity on the side opposite to the membrane. Appropriate channels can be produced very easily.

According to a further advantageous embodiment, the first pneumatics channel and the second pneumatics channel can open into the pneumatics cavity on opposite sides of the pneumatics cavity. For example, this is advantageous in order to be able to apply the first and/or the second pneumatic pressure such that the flexible membrane arches uniformly in the direction of the pneumatics space or the fluidics space, for example by means of the application of a negative pressure or positive pressure in the pneumatics space in relation to the pressure of the fluidics space, for example in order to introduce the liquid into the fluidics cavity by means of pressure. If the pneumatics channels open into the pneumatics cavity at a maximum distance apart, a largest possible section of the membrane can be covered by a pressure medium conducted through the pneumatics channels and thus be made to oscillate. Alternatively, the second pneumatics channel can open centrally into the pneumatics cavity. To this end, the second pneumatics channel can, for example, be arranged centrally on the side of the pneumatics cavity that is opposite to the membrane and be guided through the cover of the pneumatics cavity. This arrangement of the second pneumatics channel may, for example, be advantageous for a particular deflection of the flexible membrane through the generation of a pressure difference between the first and the second pneumatics channel.

According to one embodiment, the first and/or the second pneumatics channel can have a cross-sectional area of less than 0.5 $mm^2$. Advantageously, the oscillation of the flexible membrane can be achieved particularly effectively when a pneumatic pressure medium, for example pressurized air, flowing in through the first and/or the second pneumatics channel flows into the pneumatics space through the appropriate cross-sectional area like from a nozzle. Formation of turbulences and oscillations of the liquid due to the oscillation of the flexible membrane can be promoted as a result, and this may be advantageous for processing liquids, for example for mixing.

According to one embodiment, the microfluidic device can moreover comprise a fluidics capillary for introducing the liquid or at least one further liquid into the fluidics space. The fluidics capillary can open into the fluidics space. The fluidics capillary can, for example, open into the fluidics space at a flat angle or in parallel to the flexible membrane. The fluidics capillary can, for example, also be used for discharging the liquid out of the fluidics space, or the fluidics space can have a different discharge opening.

According to one embodiment, the first pneumatics channel can comprise a pneumatics capillary. The pneumatics capillary can be shaped for introducing pressure into the pneumatics space along the membrane. The pneumatics capillary can, for example, open into the pneumatics space at a flat angle or in parallel to the flexible membrane. To this end, the pneumatics capillary can, for example, have a hollow. The pneumatics capillary can, for example, be guided through the pneumatics substrate or through the fluidics substrate. The first pneumatics channel can, for example, moreover have an opening for introducing the pressure, for example in the form of a fluid pressure medium, the opening being arranged on the side of the pneumatics substrate that is opposite to the membrane. The pressure in the form of a fluid pressure medium can be introduced into the pneumatics space along the membrane, for example in the form of pressurized air or nitrogen as pressure medium. This embodiment is advantageous, since the oscillation of the flexible membrane can be achieved particularly effectively when the pressure medium is introduced into the pneumatics space at a flat angle or in the plane of the relaxed membrane.

The fluidics substrate can have a recess which opens into the fluidics cavity. At the same time, it is possible for the membrane to be deflectable into the recess in order to shape a pneumatics capillary as a variable region arranged between the pneumatics substrate and the membrane. The pneumatics capillary can therefore be designed as a region in which the flexible membrane is not connected to the pneumatics substrate and can be deflected away therefrom. Advantageously, oscillations can be promoted by the restoring force of the deflected membrane.

According to a further advantageous embodiment, the fluidics capillary can open into the recess, wherein the membrane fluidically separates the first pneumatics channel from the fluidics capillary. It is advantageous when the recess opens into the fluidics cavity, since the region of the recess that is not utilized as a pneumatics capillary according to this embodiment can also be used as a liquid-guiding channel. At the same time, the membrane can separate the liquid-guiding region of the recess from the region of the recess that shapes the pneumatics capillary, and this allows a compact design.

According to one embodiment, the microfluidic device can moreover comprise a pressure device. The pressure device can be coupled to the first pneumatics channel and the second pneumatics channel. To this end, the pressure device can be designed to apply the first pneumatic pressure to the first pneumatics channel and the second pneumatic pressure to the second pneumatics channel. Advantageously, a pneumatic pressure can thus be applied by means of the pressure device, for example by means of the introduction of a fluid as pressure medium, for example pressurized air or nitrogen. By means of the pressure device, it is, for example, possible to apply the first pneumatic pressure to the first pneumatics channel, which can, for example, have a particular pressure level which is, for example, a negative pressure or a positive pressure in relation to the pressure in the fluid cavity. The second pneumatic pressure can correspond in pressure level to the first pneumatic pressure, or have a different pressure level for generating a pressure difference in the pneumatics space, and this advantageously allows a particularly rapid and efficient processing of the liquid. The pressure device used can be known devices for pressure generation. For example, the pressure device can comprise at least one pump.

According to one embodiment, the pressure device can be designed to apply a first negative pressure in relation to the pressure in the fluidics cavity as the first pneumatic pressure to the first pneumatics channel and to apply a second negative pressure in relation to the pressure in the fluidics cavity to the second pneumatics channel as the second pneumatic pressure. In this connection, the second negative pressure can have a pressure level different to the first negative pressure in order to bring about an oscillation of the membrane arched by the first and second negative pressure in the direction of the pneumatics cavity. For example, if the second pneumatic pressure on the second pneumatics channel has a higher pressure level than the first pneumatic pressure on the first pneumatics channel, the resultant pressure difference can cause the fluid pressure medium to flow along the flexible membrane from the second pneumatics channel to the first pneumatics channel. As a result, the flexible membrane can be made to move and can, depending on the pressure difference applied, start to oscillate or vibrate.

Moreover, the pressure device can, according to one embodiment, be designed to apply a negative pressure in relation to the pressure in the pneumatics cavity as the first pneumatic pressure to the first pneumatics channel and/or to apply a negative pressure in relation to the pressure in the pneumatics cavity as the second pneumatic pressure to the second pneumatics channel. This can bring about an enlargement of the fluidics space by arching of the flexible membrane into the pneumatics cavity in order to introduce the liquid or at least one further liquid into the fluidics space. Advantageously, by means of the negative pressure in the pneumatics space, the relevant liquid can thus be drawn, for example, from an adjacent fluidics cavity into the fluidics space, for example in order to mix the liquid with another liquid.

What is moreover advantageous is one embodiment in which the pressure device is designed to apply a first positive pressure in relation to the pressure in the fluidics cavity as the first pneumatic pressure to the first pneumatics channel and to apply a second positive pressure in relation to the pressure in the fluidics cavity to the second pneumatics channel as the second pneumatic pressure. The second positive pressure can have a pressure level different to the first positive pressure in order to bring about an oscillation of the membrane arched by the first and second positive pressure in the direction of the fluidics cavity. Advantageously, in this embodiment, the setting of the oscillation of the membrane by means of the setting of the pressure difference between the applied first and second pneumatic pressure can avoid bubble formation in the liquid, and this may be advantageous when processing the liquid in connection with diagnostic methods.

What is moreover presented is a method for processing at least one liquid arranged in a fluidics space using a flexible membrane. The membrane is designed to fluidically separate a fluidics space extending into a fluidics cavity at least in part and a pneumatics space extending into a pneumatics cavity at least in part from one another. The method comprises at least a step of applying a first pneumatic pressure to the pneumatics space and a step of applying a second pneumatic pressure to the pneumatics space. The second pneumatic pressure can differ from the first pneumatic pressure in order to bring about an oscillation of the flexible membrane for processing of the at least one liquid. This is advantageous in order to be able to influence flow conditions of the at least one liquid to be processed by influencing a movement of the membrane, for example an oscillation or vibration of the membrane. For example, laminar and turbulent flows can thus be specifically set, for example specifically in a temporal manner, in a stationary manner and at a defined intensity by means of setting of the pressure difference. The mixing of two liquids can, for example, be effected particularly efficiently as a result, particularly the mixing of difficult-to-mix liquids such as, for example, liquids having differing polarity or high viscosity.

According to one embodiment, the method can moreover comprise a step of applying a negative pressure in relation to the pressure in the pneumatics cavity as the first pneumatic pressure to the pneumatics space. What can additionally or alternatively be applied in this application step is a negative pressure in relation to the pressure in the pneumatics cavity as the second pneumatic pressure to the pneumatics space in order to bring about an enlargement of the fluidics space by arching of the flexible membrane into the pneumatics cavity in order to introduce at least one liquid into the fluidics space. Advantageously, a liquid can thus be introduced into the fluidics space particularly rapidly and efficiently, for example in order to mix the introduced liquid in the fluidics space with a further liquid or a prestored dry reagent. Moreover, what can also be applied instead of a negative pressure is a positive pressure as first and/or as second pneumatic pressure. This is, for example, advantageous when the liquid has a particularly small liquid volume. In this case, the liquid can also be foamed up by the oscillation of the membrane. This may, for example, be advantageous for diffusion-driven processes or binding mechanisms when it is expedient to maximize the surface area of the liquid for processing of the liquid.

BRIEF DESCRIPTION OF THE DRAWINGS

Exemplary embodiments of the approach presented here are depicted in the drawings and more particularly elucidated in the following description, where.

DETAILED DESCRIPTION

In the following description of favorable exemplary embodiments of the present disclosure, identical or similar reference signs are used for the elements that are depicted in the various figures and act in a similar manner, to dispense with a repeated description of said elements.

Figure 1:
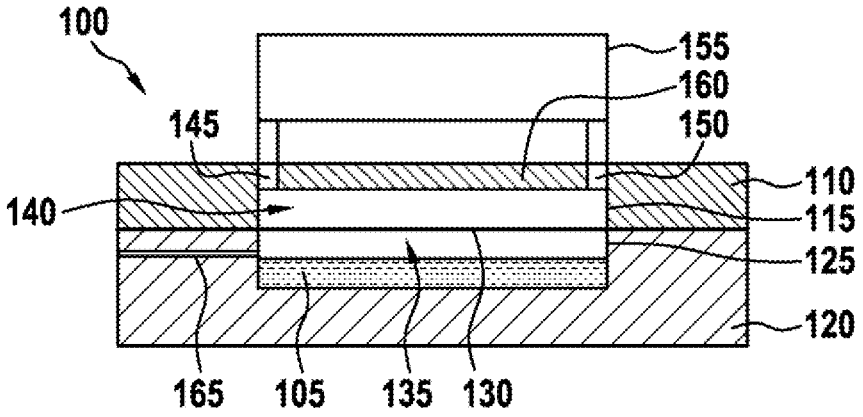
FIG. 1 shows a schematic representation of a microfluidic device for processing a liquid according to one exemplary embodiment.

FIG. 1 shows a schematic representation of a microfluidic device 100 for processing a liquid 105 according to one exemplary embodiment. A cross-sectional view of the microfluidic device 100 is shown. The microfluidic device 100 comprises a pneumatics substrate 110 having a pneumatics cavity 115 and a fluidics substrate 120 having a fluidics cavity 125 for accommodating the liquid 105. The fluidics cavity 125 is arranged opposite to the pneumatics cavity 115. Moreover, the microfluidic device 100 comprises a flexible membrane 130 which is arranged between the pneumatics substrate 110 and the fluidics substrate 120. The flexible membrane 130 is designed to fluidically separate a fluidics space 135 extending into the fluidics cavity 125 at least in part and a pneumatics space 140 extending into the pneumatics cavity 115 at least in part from one another. In FIG. 1, the flexible membrane 130 is shown in a relaxed state in which the flexible membrane 130 is arranged centrally between the fluidics cavity 125 and the pneumatics cavity 115. Furthermore, the microfluidic device 100 comprises a first pneumatics channel 145 for applying a first pneumatic pressure to the pneumatics space 140 and a second pneumatics channel 150 for applying a second pneumatic pressure to the pneumatics space 140.

According to the exemplary embodiment shown here, the microfluidic device 100 optionally comprises a pressure device 155 which is coupled to the first pneumatics channel 145 and the second pneumatics channel 150. The pressure device 155 is designed to apply the first pneumatic pressure to the first pneumatics channel 145 and the second pneumatic pressure to the second pneumatics channel 150. The flexible membrane 130 can be made to move in an oscillating or vibrating manner by the application of a defined pressure difference across the first pneumatics channel 145 and the second pneumatics channel 150, for example by the application of a first pneumatic pressure and a second pneumatic pressure differing from the first pneumatic pressure. By means of pneumatic actuation, it is thus possible for the flexible membrane 130 via a deflection to, for example, displace the liquid 105 from the fluidics space 135, or for valves to open or close. As a result of the oscillation of the membrane 130, the liquid 105 in the fluidics space 135 opposite to the pneumatics space 140 can experience turbulent flow conditions. Advantageously, laminar or turbulent flows can thus be set specifically in a temporal manner, in a stationary manner and at a defined intensity. Advantageously, this allows great flexibility of the microfluidic device 100, especially since the defined setting of turbulent flows, turbulences or transverse flows of the liquid 105 can be controlled solely by defined pressure differences, largely independently of the geometries of the microfluidic device 100. The controlled setting of flow conditions of liquids 105 allows different binding conditions between capture and binding molecules to be expressed in a temporal, local and intensity-dependent manner. This can, for example, allow an efficient mixing of liquids 105. Advantageously, the mixing of the liquids 105 does not require pumping back and forth between various cavities, but can take place in an individual cavity, the fluidics cavity 125. This leads to an area saving on the microfluidic device 100 and can advantageously increase mixing efficiency especially in the case of very difficult-to-mix liquids 105, for example liquids 105 having a high viscosity, having differing polarity or only partial miscibility or for the dissolution of dry reagents in aqueous solutions. The mixing of the liquid 105 can, for example, also be quickened in diffusion-driven processes as a result, and this can allow more rapid diagnoses.

According to the exemplary embodiment shown here, the pneumatics cavity 115 has a cover 160 opposite to the membrane 130. The first pneumatics channel 145 and the second pneumatics channel 150 are guided through the cover 160 into the pneumatics cavity 115 and open into the pneumatics cavity 115 on opposite sides of the pneumatics cavity 115.

Moreover, the microfluidic device 100 comprises, according to the exemplary embodiment shown here, a fluidics capillary 165 for introducing the liquid 105 into the fluidics space 135.

The microfluidic device 100 can, for example, be used in conjunction with a medical diagnosis system, or with a chip laboratory, a so-called lab-on-chip. As shown here, the microfluidic device 100 can have a multilayer structure composed of the pneumatics substrate 110, the fluidics substrate 120 and the flexible membrane 130, the membrane 130 fluidically separating the pneumatics cavity 115 and the fluidics cavity 125 from one another. This arrangement can provide the fundamental function of the microfluidic device 100 of microfluidic control. The pneumatics substrate 110 and the fluidics substrate 120 can, for example, be polymer substrates and accordingly consist of plastics, for example of thermoplastic, for example of PC, PA, PS, PP, PE, PMMA, COP or COC; moreover, the multilayer structure can also comprise glass. The membrane 130 which is integrated between the pneumatics substrate 110 and the fluidics substrate 120 and is freely movable can, for example, be an elastomer, for example a thermoplastic elastomer composed of TPU or TPS, or the membrane 130 can consist of hot-melt adhesive films. Furthermore, the membrane 130 can comprise a barrier film or sealing film, for example a commercial polymer composite film composed of polymeric sealing and protective layers, for example composed of PE, PP, PA or PET, and a barrier layer, for example composed of vapor-deposited aluminum or other high-barrier layers such as EVOH, BOPP, or an aluminum composite film having multilayer sealing layers composed of polymers such as PP, PE, acrylic adhesive or polyurethane adhesive. Suitable as joining processes for said multilayer structure of the microfluidic device 100 are laser transmission welding, ultrasonic welding, thermobonding, adhesive bonding, clamping or comparable processes. Moreover, reservoirs, for example the pneumatics cavity 115 and the fluidics cavity 125, can have a coating, for example with Al, $Al_2O_3$ or $SiO_2$. As a result of the application of a negative pressure in the pneumatic plane of the pneumatics cavity 115 and of the pneumatics space 140 by means of the pressure device 155, the flexible membrane 130 can be deflected and draw in liquids 105.

The multilayer structure of the microfluidic device 100 comprising at least the pneumatics substrate 110, the fluidics substrate 120 and the flexible membrane 130 can, for example, have a thickness of 0.5 to 5 mm. As a polymer membrane, the membrane 130 can, for example, have a thickness of 5 to 300 μm. As an elastic TPU membrane, the membrane 130 can, for example, have a thickness of 50 μm to 2 mm. According to one exemplary embodiment, the first pneumatics channel 145 and/or the second pneumatics channel 150 can have a cross-sectional area of less than 0.5 $mm^2$. By means of the first and second pneumatic pressure applied to the first pneumatics channel 145 and to the second pneumatics channel 150, it is, for example, possible to generate a pressure difference of 0.1 to 5 bar in the pneumatics plane of the pneumatics cavity 115 and of the pneumatics space 140.

Figure 2A:
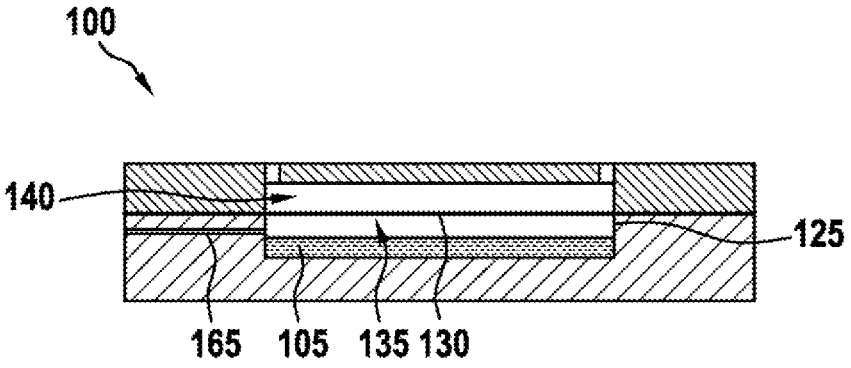
FIGS. 2*a* to 2*e* show a schematic representation of a microfluidic device for processing a liquid according to one exemplary embodiment.
Figure 2B:
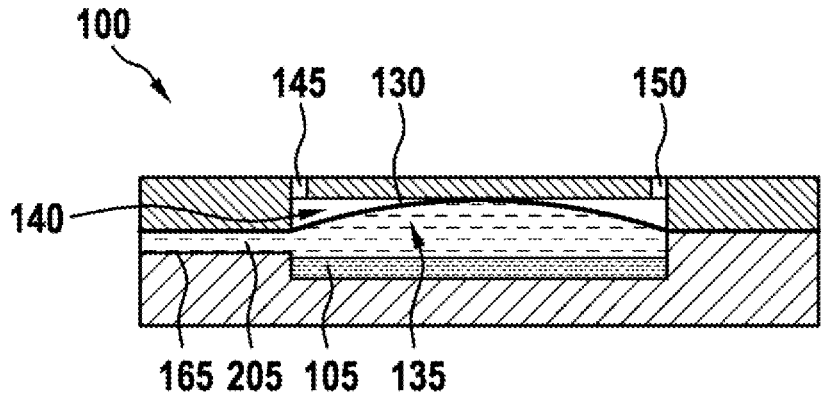
Figure 2C:
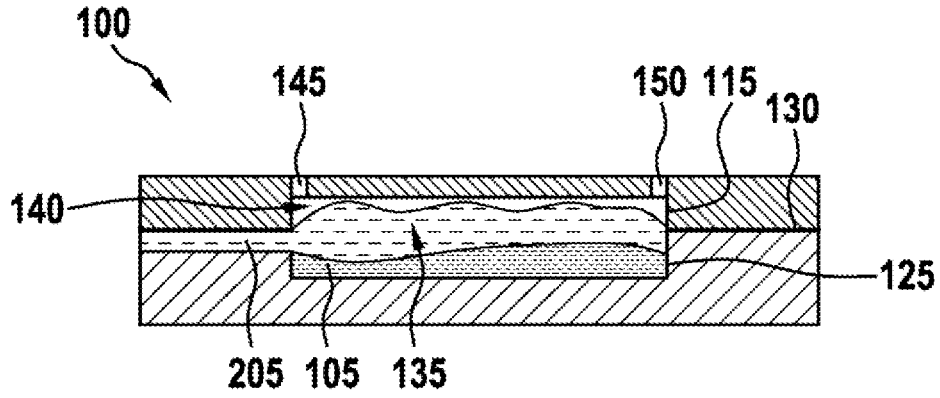
Figure 2D:
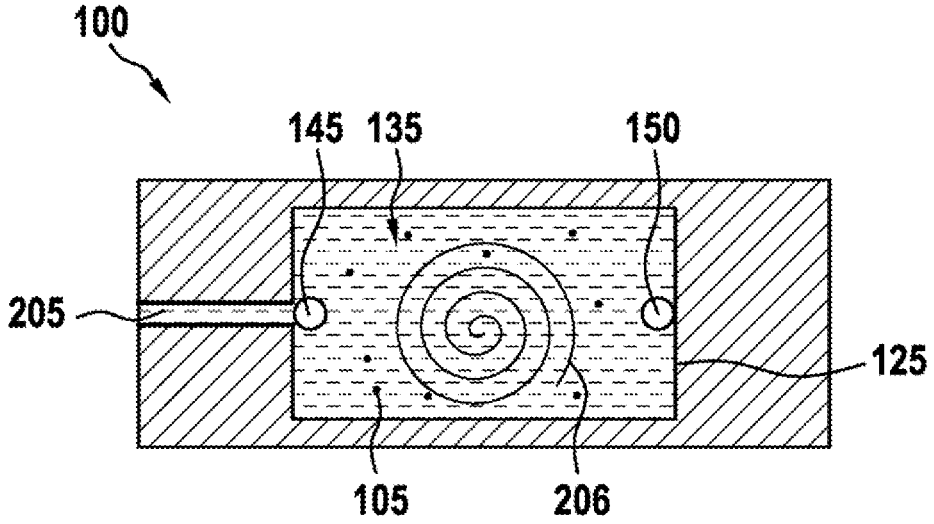

FIGS. 2*a* to 2*e* each show a schematic representation of the microfluidic device 100 for processing a liquid 105 according to one exemplary embodiment. As an example of processing, what is shown is an efficient mixing of liquids 105 by a specific generation of turbulent flows in the liquids 105, which can be generated by means of a differential negative pressure in the microfluidic device 100. FIGS. 2*a*, 2*b*, 2*c* and 2*e* each show a cross-sectional view of the microfluidic device 100, each showing by way of example a different situation of the processing of the liquid 105. FIG. 2*d* shows by way of example flow conditions of the liquid 105 accommodated by the microfluidic device 100, with the situation of the processing of the liquid 105 that is shown in FIG. 2*c* being depicted in top view.

FIG. 2*a* shows the microfluidic device 100. According to the exemplary embodiment shown here, the liquid 105 is situated in the fluidics space 135 of the fluidics cavity 125. To this end, the liquid 105 can, for example, be a prestored or already introduced liquid reagent, for example a salt-containing or ethanol-containing or aqueous solution, or a patient sample, for example blood. The liquid 105 can, for example, be introduced or have been introduced into the fluidics space 135 through the fluidics capillary 165. The fluidics space 135 is only about half-filled by the liquid 105. In the situation shown here, the membrane 130 does not have an evident deflection due to a pressure difference in the pneumatics space 140 in the form of arching or oscillation; the pneumatics space 140 and the fluidics space 135 which are separated from one another by the membrane 130 are virtually identical in size.

FIG. 2*b* shows a further situation of the processing of the liquid 105 of the microfluidic device 100. In addition to the liquid 105 already situated in the fluidics space 135, a further liquid 205 is introduced here into the fluidics space via the fluidics capillary 165. The liquid 205 is drawn in by the application of a negative pressure in the pneumatics space 140 in relation to the pressure in the fluidics space 135 as a first pneumatic pressure to the first pneumatics channel 145. As pneumatic pressure, it is, for example, possible to introduce a fluid pressure medium into the pneumatics space 140. Additionally, the negative pressure can also be applied as a second pneumatic pressure to the second pneumatics channel 150. As a result of the negative pressure generated, the flexible membrane 130 is deflected and draws in the liquid volume of the liquid 205 from an adjacent cavity. As a result of drawing in a second liquid 205, it is possible, depending on the miscibility of the liquids 105 and 205, for two phases to form, as in the situation shown here.

FIG. 2*c* shows the mixing of the liquids 105 and 205 as one situation of the processing in the microfluidic device 100. What is applied to the second pneumatics channel 150 as a second pneumatic pressure is a negative pressure in relation to the pressure prevailing in the fluidics space 135. The second pneumatic pressure has a higher pressure level than the first pneumatic pressure. At the same time, the first pneumatic pressure is likewise lower than the pressure prevailing in the fluidics space 135. Owing to the resultant pressure difference between the pneumatics channels 145, 150, the pressure medium, for example air or nitrogen, of the pneumatic pressure flows along the flexible membrane 130 from the second pneumatics channel 150 into the first pneumatics channel 145. As a result, the flexible membrane 130 is made to move and, depending on the pressure difference applied, starts to oscillate or vibrate. This is shown here by the wavy deflections of the arched membrane 130. The negative pressure in the pneumatics space 140 and the pneumatics cavity 115 remains unchanged relative to the fluidics space 135 and the fluidics cavity 125, in which ambient pressure prevails, with the result that the flexible membrane 130 continues to remain deflected into the pneumatics cavity 115. The fluidics space 135 is thereby enlarged and expands into the pneumatics cavity 115, whereas the pneumatics space 140 is made smaller by the deflection of the membrane 130. The pressure difference to make the membrane 130 move in an oscillating manner can also be generated by applying to the second pneumatics channel 150 a pneumatic pressure having a lower pressure level than the pressure level of the first pneumatic pressure applied to the first pneumatics channel 145. In this case, the pressure medium flows across the flexible membrane 130 in the opposite direction.

Figure 2E:
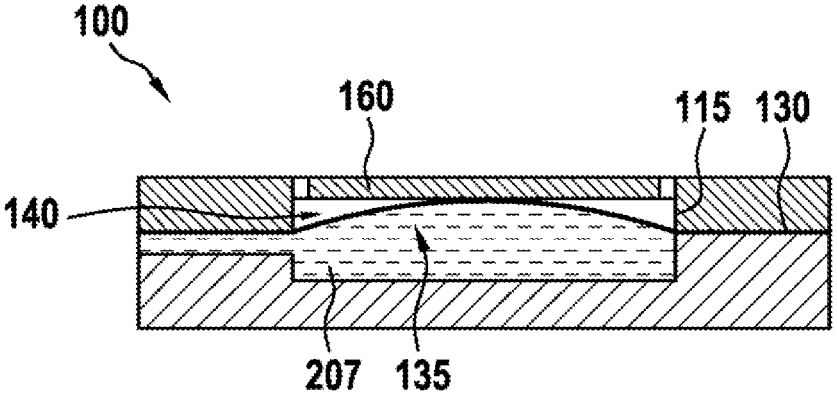

By way of example, FIG. 2*d* shows flow conditions of the liquid 205 when mixing with the liquid 105 situated in the fluidics space 135 of the fluidics cavity 125. The mixing of the two liquids 105, 205 is shown by a few points depicting the liquid 205 in the fluidics space 135, with the points indicating the liquid 105. The situation shown here corresponds to the mixing situation shown in the preceding FIG. 2*c*, but a top view of the fluidics space 135 is shown here in order to show the flow conditions of the liquid 205 when mixing the liquid 105 using a membrane oscillating due to the pressure difference. The vibration of the flexible membrane is directly transmitted to the fluidics cavity 125 and sets the two liquids 105, 205 situated therein in motion in a uniform manner. This is shown here by the vortex 206 by way of example. This can achieve a very efficient, temporally and locally controlled mixing of the liquids 105, 205; the result of the mixing is shown in FIG. 2*e* which follows. As a result of the application of particular pressure differences by means of application of the first pneumatic pressure to the first pneumatics channel and of the second pneumatic pressure differing from the first pneumatic pressure to the second pneumatics channel 150, it is also possible to form vortex effects 205, which further increase mixing efficiency, from the turbulent flows.

FIG. 2*e* shows the result of the processing of the liquid in the microfluidic device 100. A mixed liquid 207 in the fluidics space 135 is shown. The liquid 207 is the result of the mixing of the two liquids in the preceding FIGS. 2*b* to 2*d* in the microfluidic device 100. In the exemplary embodiment shown here, the membrane 130 is arched owing to the negative pressure in the pneumatics space 140 and reaches in part up to the cover 160 of the pneumatics cavity 115, with the result the fluidics space 135 containing the liquid 207 expands into the pneumatics cavity 115 and displaces the pneumatics space 140 into the upper corner regions of the pneumatics cavity 115.

FIGS. 3*a* to 3*d* show a schematic representation of a microfluidic device 100 for processing a liquid 105 according to one exemplary embodiment. What is shown in each case is one situation of the efficient dissolving and subsequent mixing of a dry reagent 305, a so-called bead, in liquid reagents as liquid 105 by a specific generation of turbulent flows in the liquid 105 by means of a differential negative pressure. The situations are each shown in a cross-sectional view of the microfluidic device 100.

Figure 3A:
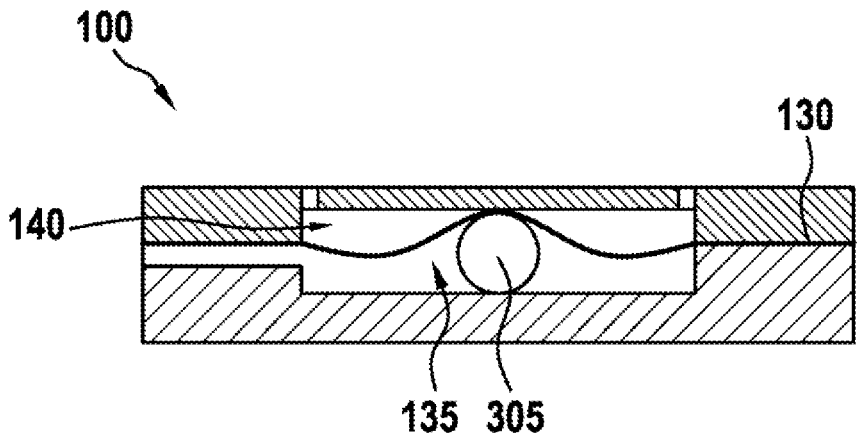
FIGS. 3*a* to 3*d* show a schematic representation of a microfluidic device for processing a liquid according to one exemplary embodiment.

FIG. 3*a* shows the microfluidic device 100, containing a prestored bead as dry reagent 305 in the fluidics space 135. The dry reagent 305 is fixed by the flexible membrane 130, even without the application of pressurized air as pressure medium, pneumatic pressure or a negative pressure in the pneumatics space 140. In the exemplary embodiment shown here, the microfluidic device 100 is utilized for efficient dissolution of the dry reagent 305, there being shown here the starting situation even before the start of processing of the liquid.

Figure 3B:
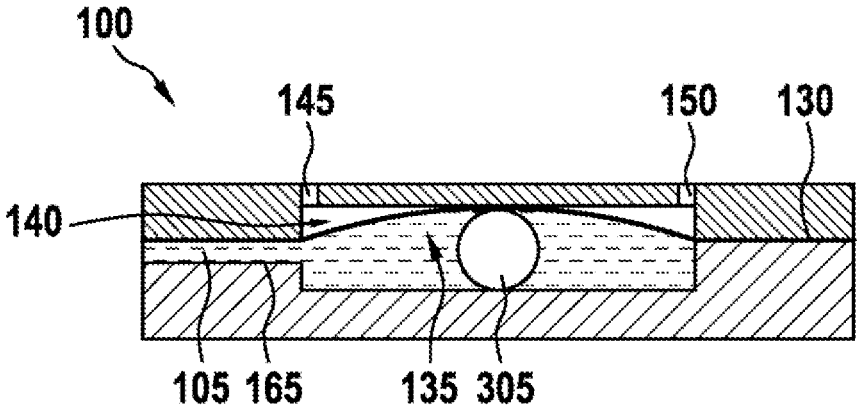

FIG. 3*b* shows a further situation of processing of the liquid 105. What is shown is that the liquid 105 is drawn via the fluidics capillary 165 into the fluidics space 135, where it starts to mix with the dry reagent 305 to be dissolved. As a result of the application of a negative pressure in the pneumatics space 140 in relation to the pressure in the fluidics space as first and second pneumatic pressure to the first pneumatics channel 145 and to the second pneumatics channel 150 in the form of the application of pressurized air, the flexible membrane 130 is deflected and draws in the liquid 105 in the form of liquid reagent from an adjacent cavity. The dry reagent 305 starts to dissolve at least on the surface.

Figure 3C:
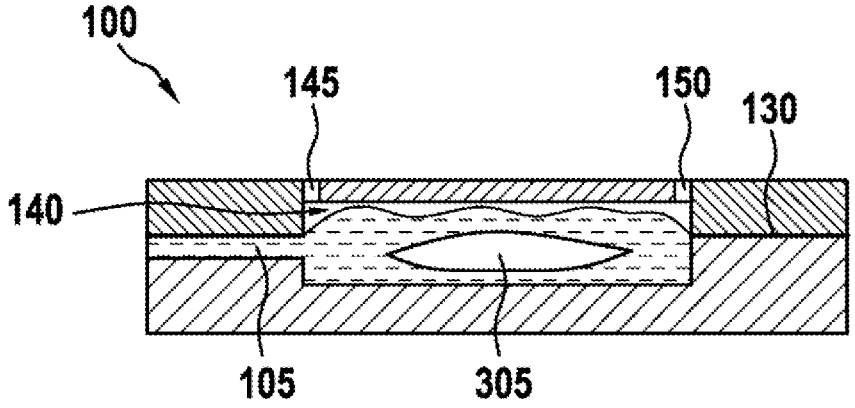

FIG. 3*c* shows the mixing of the liquid 105 with the dry reagent 305 in a further processing phase in the microfluidic device 100. To quicken the dissolution of the dry reagent 305 and to subsequently distribute the concentration uniformly, the flexible membrane 130 is made to oscillate by the generation of a pressure difference between the first pneumatics channel 145 and the second pneumatics channel 150. This leads to an efficient and quickened dissolution and mixing of the dry reagent 305 in the liquid 105; accordingly, the original shape of the dry reagent 305 is no longer identifiable. The dry reagent 305 dissolves and it mixes further with the liquid 105.

Figure 3D:
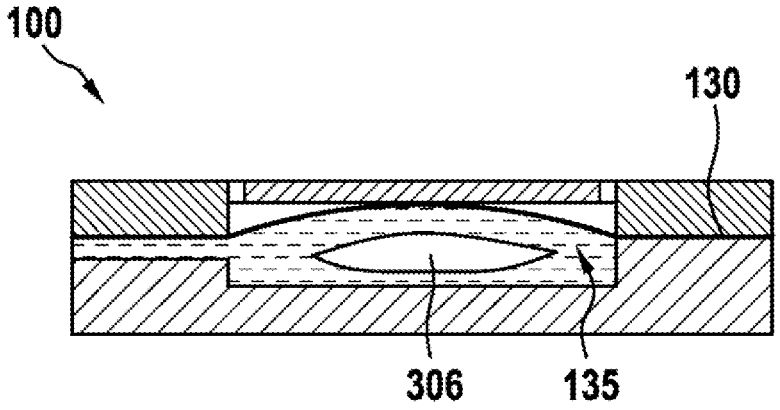

FIG. 3*d* shows the result of the processing of the liquid in the microfluidic device 100. The dry reagent in the form of the bead has dissolved by means of the oscillation of the membrane 130 and has mixed with the introduced liquid right up to complete dissolution and homogeneously distributed concentration of the dry reagent, thus yielding the liquid 306 as the result of mixing. Advantageously, the defined combination of turbulent and laminar flow conditions due to the pneumatic actuation of the membrane 130 makes it possible in the same cavity, the fluidics space 135, to carry out processes to mix, enrich and separate liquids, dry reagents, magnetic beads, circulating tumor cells and patient samples in a single microfluidic cavity, the fluidics space 135.

FIGS. 4*a* to 4*d* show a schematic representation of a microfluidic device 100 for processing a liquid 105 according to one exemplary embodiment. One situation of the processing of the liquid 105 is shown in each case in a cross-sectional view of the microfluidic device 100, there being shown here the temporary reduction of gas-bubble formation in the liquid 105 due to thermal energy input by turbulent flows by means of a differential negative pressure when processing the liquid 105. In many chip laboratory applications, which can, for example, be carried out using the microfluidic device 100, it is necessary to locally heat the liquid reagents used, i.e., the liquid 105, for example for a polymerase chain reaction, for a hybridization, a qPCR, or a real-time PCR. The thermal energy input lowers the gas-solubility of the air trapped in the liquid volume of the liquid 105, forming larger individual air bubbles. These can be redissolved or minimized by temporally controlled setting of the turbulent flow, even during a polymerase chain reaction for example. This is shown in the following FIGS. 4*a* to 4*d* by way of example.

Figure 4A:
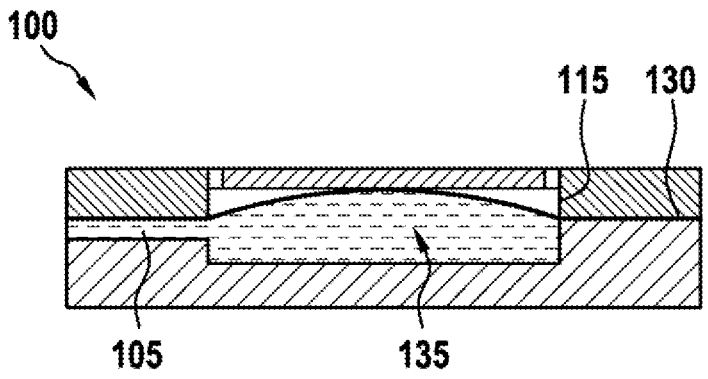
FIGS. 4*a* to 4*d* show a schematic representation of a microfluidic device for processing a liquid according to one exemplary embodiment.

FIG. 4*a* shows the starting situation of the processing of the liquid 105 in the microfluidic device 100 before the local heating of the liquid 105. The liquid 105 is situated in the fluidics space 135, and the flexible membrane 130 is arched in the direction of the pneumatics cavity 115.

Figure 4B:
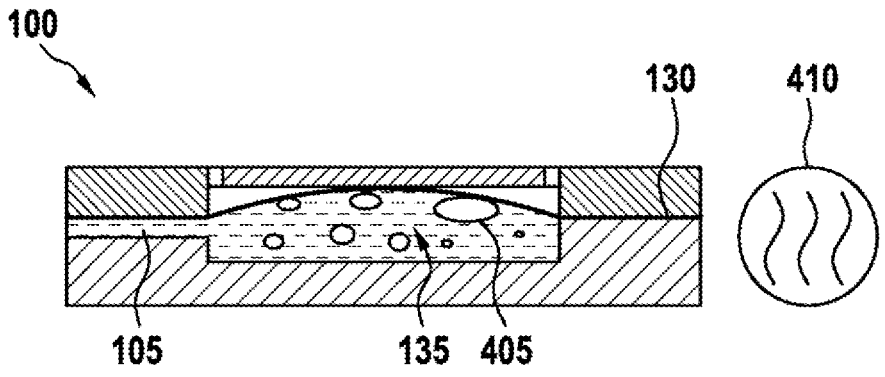

FIG. 4*b* shows bubble formation 405 in the liquid 105 due to local heating 410 of a liquid plug, i.e., of a particular liquid volume of the liquid, such as the liquid volume of the liquid 105 that is situated here in the fluidics space 135. The local heating 410 of a liquid plug, for example in the case of a polymerase chain reaction, an array hybridization, a qPCR or a real-time PCR, lowers the gas-solubility of the liquid 105, and this is reflected in bubble formation 405 in the fluidics space 135. These gas bubbles arising in the bubble formation 405 can cause problems in the reading, detection and evaluation following the processing of the liquid 105. By using the microfluidic device 100, it is advantageously possible to avoid or reduce the bubble formation 405, as shown in the following two FIGS. 4*c* and 4*d*.

Figure 4C:
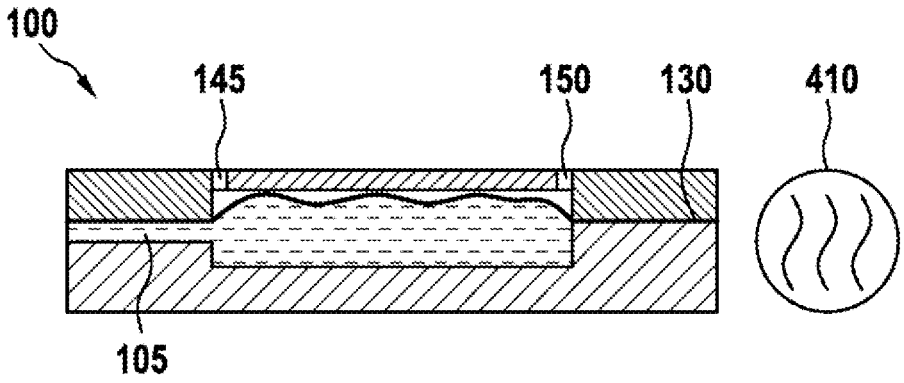

FIG. 4*c* shows, by way of example, how gas bubbles arising due to the local heating 410 when processing a liquid 105 can be avoided or reduced using the microfluidic device 100 according to one exemplary embodiment. As a result of the controlled setting of a turbulent flow in the liquid 105, it is possible for especially larger bubbles to be reduced and made distinctly smaller. The setting of the turbulent flows in the liquid 105 is achieved by means of the setting of the oscillation of the flexible membrane 130. The oscillation of the membrane 130 can be set by a pressure difference in the pneumatics space that is generated between the first pneumatics channel 145 and the second pneumatics channel 150, and by the flow of a fluid pressure medium across the flexible membrane 130 from the first pneumatics channel 145 to the second pneumatics channel 150 as an effect of the pressure difference. In this figure, the oscillation of the flexible membrane 130 is depicted by the deflections of the membrane by way of example.

Figure 4D:
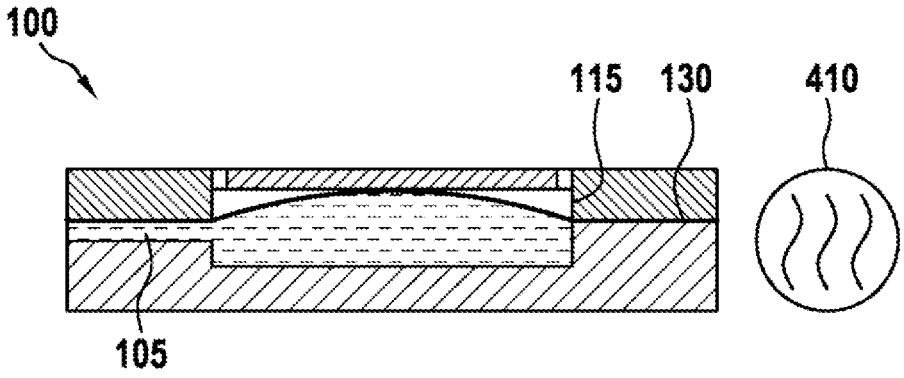

FIG. 4*d* shows the result of the processing of the liquid 105 in the microfluidic device 100. The result of the processing of the liquid 105 is shown here; the membrane 130 no longer exhibits oscillation, it is deflected in the direction of the pneumatics cavity 115 and, despite the local heating 410, there are hardly any large gas bubbles in the liquid 105, as depicted in FIG. 4*b* by way of example. The reduction or the avoidance of bubble formation offers enormous advantages in the subsequent reading in a diagnostic method for which the liquid 105 is processed. The cause of air bubbles in microfluidic systems such as the microfluidic device 100 can also be trapped air in dry reagents or beads that only appears in the form of bubble formation upon dissolution of a bead. Moreover, air in the microfluidic system such as the microfluidic device 100 can always remain in the system to a slight extent even after filling of the channels with liquid 105. Therefore, it is advantageous to use the oscillation of the membrane 130, in a temporary manner as well, when processing the liquid 105 in order to permanently suppress system-related bubble formation, even if the liquid 105 is not locally heated.

Figure 5A:
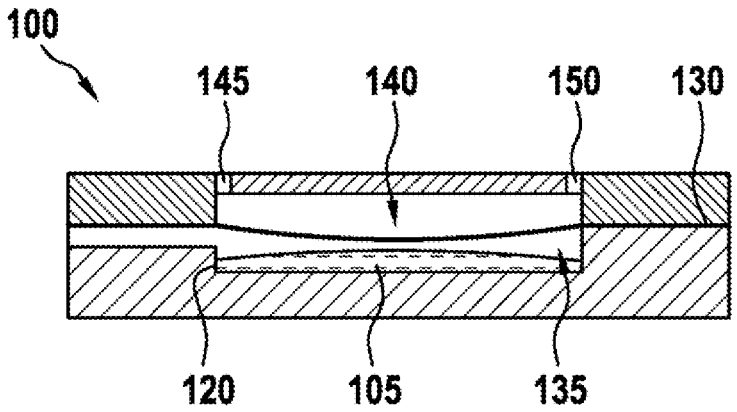
FIGS. 5*a* to 5*c* show a schematic representation of a microfluidic device for processing a liquid according to one exemplary embodiment.
Figure 5B:
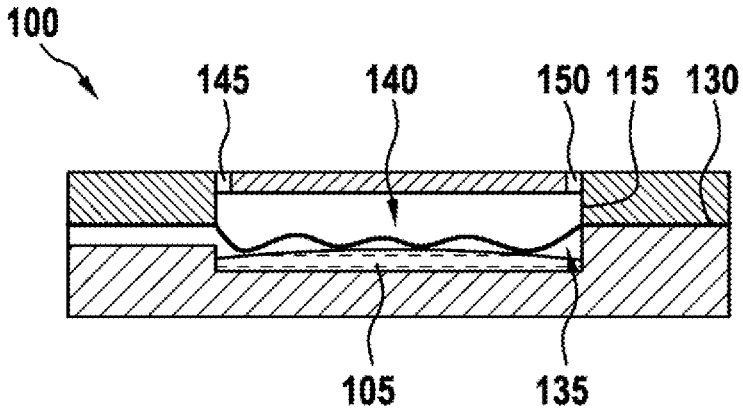
Figure 5C:
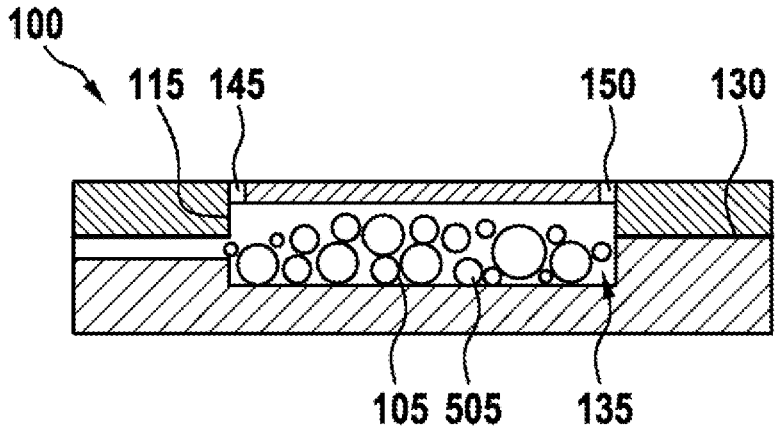

FIGS. 5*a* to 5*c* show a schematic representation of a microfluidic device 100 for processing a liquid 105 according to one exemplary embodiment. The cross-sections of the microfluidic device 100 each show one processing situation. Here, the liquid 105 is foamed during processing. A small liquid volume is foamed by stress on the flexible membrane 130 with a differential positive pressure, i.e., by means of an oscillation of the membrane 130 due to pneumatic actuation. The liquid 105 can be foamed in order to be able to minimize air-bubble formation by the setting of turbulent flows in that relatively large air bubbles are foamed and air trapped thereby dissolve better in the liquid volume of the liquid 105, and this may be advantageous in the case of binding mechanisms or subsequent reading or detection steps that follow the processing of the liquid 105. Furthermore, the liquid 105 can be foamed in order to force foam formation, by the controlled setting of flow conditions of the liquid 105, in the case of a small liquid volume with a simultaneously high proportion of gas or air in order to thus afford a maximization of the surface area of the liquid 105 to be processed. This offers advantages for diffusion-driven processes or is advantageous for binding mechanisms when only smallest sample volumes of the liquid 105 are available, which volumes cannot be further diluted because of low concentrations of the binding molecules to be detected. In the following FIGS. 5*a* to 5*c*, such foaming of the liquid 105 is shown by way of example.

FIG. 5*a* shows the liquid 105 with a small liquid volume in the fluidics space 135 of the microfluidic device 100. The liquid volume of the liquid 105 has a comparatively high proportion of gas or air. What is shown is the starting situation of the processing of the liquid 105 before foaming. The membrane 130 is deflected in the direction of the fluidics cavity 120 by a positive pressure in the pneumatics space 140 in relation to the pressure in the fluidics space 135. The positive pressure in the pneumatics space 140 can be generated by the application of the positive pressure as a first pneumatic pressure to the first pneumatics channel 145 and/or as a second pneumatic pressure to the second pneumatics channel 150.

FIG. 5*b* shows the foaming of the liquid 105 by stress on the flexible membrane 130 with the aid of positive pressure in the pneumatics space 140 in relation to the pressure in the fluidics space 135. As a result of the application of positive pressure as a first pneumatic pressure to the first pneumatics channel 145 and of positive pressure differing from the first pneumatic pressure as a second pneumatic pressure to the second pneumatics channel 145, i.e., as a result of the application of positive pressure having a certain pressure difference, the flexible membrane 130 is deflected and starts to oscillate or vibrate, as shown by the deflections of the membrane 130. In this way, the liquid 105 is foamed with varying intensity depending on the pressure difference, this being depicted here by the small air bubbles in the liquid 105.

FIG. 5*c* shows a further processing phase of the foaming of the liquid 105. Negative pressure is applied following the oscillation of the membrane 130 under positive pressure. To this end, a negative pressure is applied to the first pneumatics channel 145, in relation to the pressure in the fluidics space 135, as a first pneumatic pressure. Additionally, a negative pressure can be applied to the second pneumatics channel 150 as a second pneumatic pressure, the result being that a uniform deflection of the membrane 130 in the direction of the pneumatics cavity 115 can be achieved, as shown here. As a result of the applied negative pressure and the deflection of the membrane 130, the foam 505 of the liquid 105 can spread further in the fluidics space 135 and is available for further microfluidic processing. The forced foam formation may be advantageous for diffusion-driven processes or binding mechanisms when it is expedient to maximize the surface area of the liquids 105. For example, this may be the case when only smallest sample volumes are available as liquid 105 and said sample volumes cannot be further diluted because of low concentrations of the DNA in the sample that is to be detected.

Figure 6:
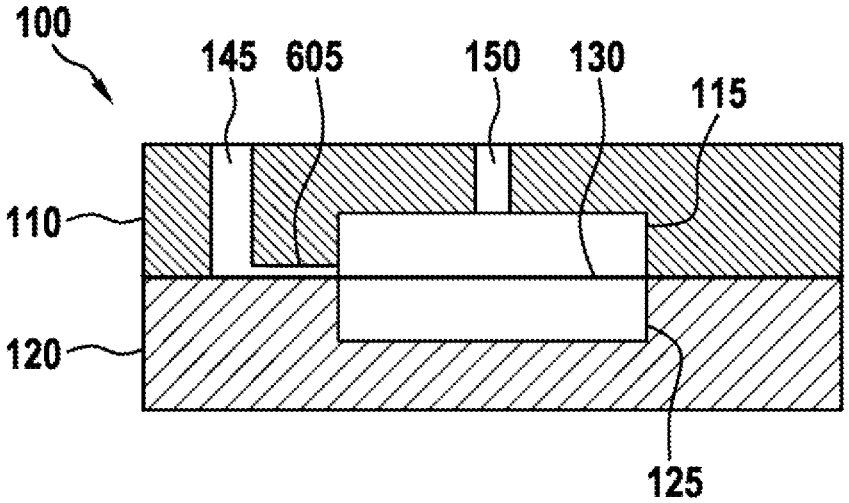
FIG. 6 shows a schematic representation of a microfluidic device for processing a liquid according to one exemplary embodiment.

FIG. 6 shows a schematic representation of a microfluidic device 100 for processing a liquid according to one exemplary embodiment. What is shown is the pneumatics substrate 110 comprising the pneumatics cavity 115 and the fluidics substrate 120 comprising the fluidics cavity 125 and also the flexible membrane 130 in a cross-sectional view of the microfluidic device 100. The fluidics space can correspond to the fluidics cavity 125 and the pneumatics space can correspond to the pneumatics cavity 115. Supply and removal fluidics channels in relation to the fluidics cavity 125 are not shown. For example, the fluidics cavity 125 can be provided with a supply channel and a removal channel for filling.

According to the exemplary embodiment shown here, the first pneumatics channel 145 and the second pneumatics channel 150 open into the pneumatics cavity 115. The second pneumatics channel 150 is guided through the pneumatics substrate 110 and opens centrally into the pneumatics cavity 115 on the side opposite to the membrane 130.

According to the exemplary embodiment shown here, the first pneumatics channel 145 comprises a pneumatics capillary 605. The pneumatics capillary 605 is shaped to introduce pressure into the pneumatics space along the membrane 130. The pneumatics capillary 605 is accordingly guided in the same plane or in parallel to the plane of the membrane 130 or at least at a very flat angle in relation to the membrane 130. According to one exemplary embodiment, the membrane 130 forms a base of the pneumatics capillary 605. Thus, the pneumatics capillary 605 can be shaped as a groove in the pneumatics substrate 110. Here, the pneumatics capillary 605 is realized as a section of the first pneumatics channel 145 that opens into the pneumatics cavity 115. The second pneumatics channel 150 can alternatively comprise a corresponding pneumatics capillary 605.

According to one exemplary embodiment, the cross-sectional area of the first pneumatics channel 145 and/or the second pneumatics channel 150 is less than 0.5 $mm^2$. The oscillation of the flexible membrane 130 can be achieved particularly effectively when the inflow of a fluid pressure medium, for example pressurized air, which can be introduced into the pneumatics space of the pneumatics cavity 115 through the first pneumatics channel 145 and/or the second pneumatics channel 150 is effected through the pneumatics capillary 605 having a small cross-section, for example having a cross-sectional area of not greater than 0.5 $mm^2$, for example 0.2 $mm^2$. In this case, the pressurized air enters the pneumatics cavity 115 like from a nozzle and the formation of turbulences and oscillations is promoted.

Moreover, the oscillation of the flexible membrane 130 can be achieved particularly effectively when the pneumatics capillary 605 opens into the pneumatics cavity 115 close to the plane of the flexible membrane 130, meaning that the air enters the pneumatics cavity 115 at a flat angle or in parallel to the flexible membrane 130, as shown here.

Figure 7:
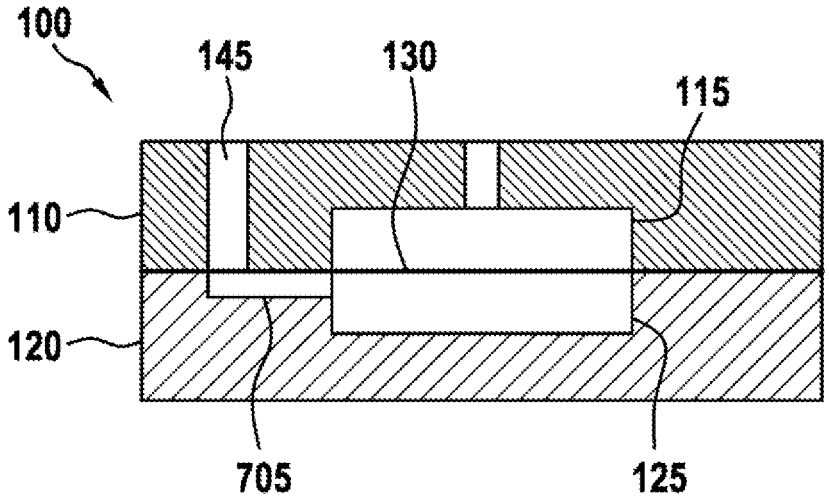
FIG. 7 shows a schematic representation of a microfluidic device for processing a liquid according to one exemplary embodiment.

FIG. 7 shows a schematic representation of a microfluidic device 100 for processing a liquid according to one exemplary embodiment. The exemplary embodiment shown here corresponds to the exemplary embodiment shown in the preceding FIG. 6 with the exception of the shaping of the pneumatics capillary for fluidic connection of the first pneumatics channel 145 to the pneumatics cavity 115. According to this exemplary embodiment, the pneumatics capillary is shapeable into a recess 705 in the fluidics substrate 120 by a deflection of the membrane 130. The recess 705 can be a hollow, especially a groove. According to the exemplary embodiment shown here, the pneumatics capillary is only shaped when the membrane 130 is deflected into the recess 705. The pneumatics capillary is thus designed as a variable region in which the flexible membrane 130 is not connected to the pneumatics substrate 110 and can be deflected from the pneumatics substrate 110 into the recess 705 in the fluidics substrate 120. This can, for example, be effected by application of a positive pressure to the first pneumatics channel 145. In the situation shown in FIG. 7, the flexible membrane 130 is relaxed and the pneumatics capillary is not formed. For example, this situation appears when the same pressure as or a lower pressure than in the fluidics cavity 125 prevails in the pneumatics channels 145, 150. In the situation subsequently shown in FIG. 8, the flexible membrane 130 is deflected into the recess 705, i.e., the hollow or the groove, and the pneumatics capillary is formed. This situation can be achieved by applying a higher pressure to the pneumatics channels 145, 150 than to the fluidics cavity 125. The recess 705 in the fluidics substrate 120 can be identical to a supply or removal channel for filling the fluidics cavity 125. This means that the flexible membrane 130 can be deflected into the fluid-guiding channel upon application of a positive pressure to the first pneumatics channel 145. As a result of the possible shaping of the pneumatics capillary that is shown here, the oscillation of the flexible membrane 130 can be achieved particularly effectively. According to one exemplary embodiment, the recess 705 extends from a region of the fluidics substrate 120 that is opposite to the first pneumatics channel 145 up to the fluidics cavity 125. According to one exemplary embodiment, the membrane 130 in the relaxed state is, in the region of the recess 705, in loose contact with a surface of the pneumatics substrate 110 that is opposite to the recess 705. A region of the recess 705 that is situated on the side of the fluidics substrate 120 in relation to the membrane 130 is fluidically separated by the membrane 130 from a region of the recess 705 that is situated on the side of the pneumatics substrate 110 in relation to the membrane 130 and thus from the first pneumatics channel 145.

Figure 8:
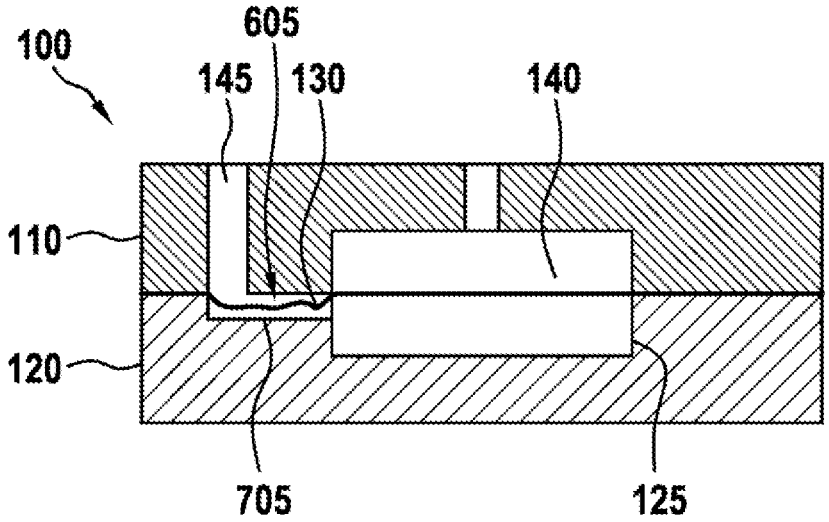
FIG. 8 shows a schematic representation of a microfluidic device for processing a liquid according to one exemplary embodiment.

FIG. 8 shows a schematic representation of the microfluidic device 100 shown in FIG. 7 for processing a liquid according to one exemplary embodiment. In the situation shown here, what is shown is the bulging of the flexible membrane 130 into the recess 705 in the fluidics substrate 120, thereby forming a pneumatics capillary 605. Assuming that a pressure p0, for example atmospheric pressure, prevails in the fluidics cavity 125 and in the recess 705, this situation can, for example, be achieved by applying a positive pressure $p1>p0$ to the first pneumatics channel 145. In one embodiment, a second pressure $p2<p1$ is applied to the second pneumatics channel 150. This has the advantage that an air flow is generated from the first pneumatics channel 145 into the pneumatics cavity 140 through the pneumatics capillary 605, the result being that the oscillation of the flexible membrane 130 can be achieved particularly effectively. The deflection of the membrane 130 can comprise an oscillation of the membrane 130 as a result of the application of the first pneumatic pressure to the first pneumatics channel 145. Owing to the restoring force of the membrane 130, it is possible in this way to promote formation of oscillations. The pressure ratios can also be dimensioned such that the flexible membrane 130 in course of the oscillation is periodically in complete contact with the pneumatics substrate 110 again and the pneumatics capillary 605 is thus only transiently formed. The system thus oscillates between the states shown in FIGS. 7 and 8. Owing to the deflection of the flexible membrane 130 into the groove 705, it is possible to introduce a pressure medium into the pneumatics space 140 via the first pneumatics channel 145. The pressure p2 can also be smaller than p0, this substantially corresponding to the application of vacuum to the second pneumatics channel 150.

Figure 9:
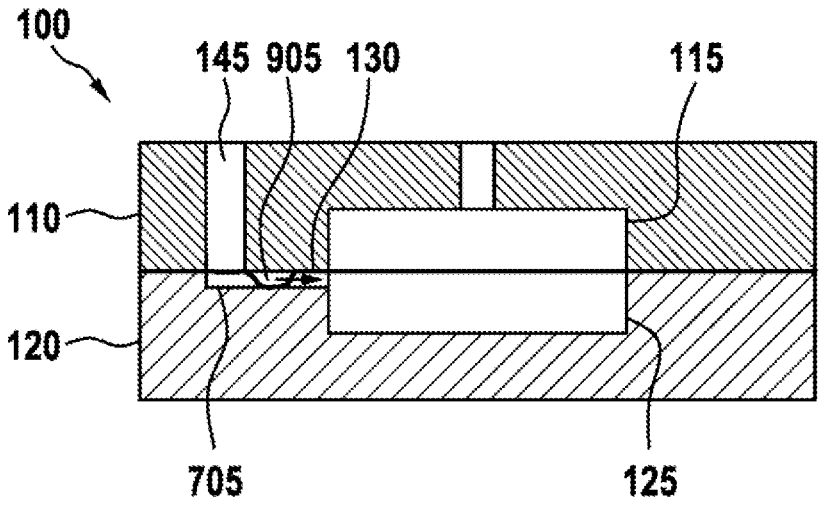
FIG. 9 shows a schematic representation of a microfluidic device for processing a liquid according to one exemplary embodiment.

FIG. 9 shows a schematic representation of a microfluidic device 100 for processing a liquid according to one exemplary embodiment. What is shown is a further situation of the exemplary embodiment shown in the preceding FIG. 8. The first pneumatic pressure can be applied to the first pneumatics channel 145 by means of the introduction of a fluid pressure medium, for example pressurized air. At the same time, the air flow of the pressurized air can be set such that, as shown here, discrete air volumes or air bubbles 905 form in each case on or below the flexible membrane 130. Said air volumes or air bubbles 905 can then escape in sudden bursts, for example at a frequency between 1 and 20 Hz, in the direction of the chamber consisting of the pneumatics cavity 115 and the fluidics cavity 125, with the result that the flexible membrane 130 is made to periodically oscillate in the chamber. Thus, there is no shaping of a pneumatics capillary leading from the first pneumatics channel 145 to the pneumatics cavity 115 without interruption, as shown in FIG. 8, but merely a section of the pneumatics capillary that moves in the direction of the fluidics cavity 125.

Figure 10:
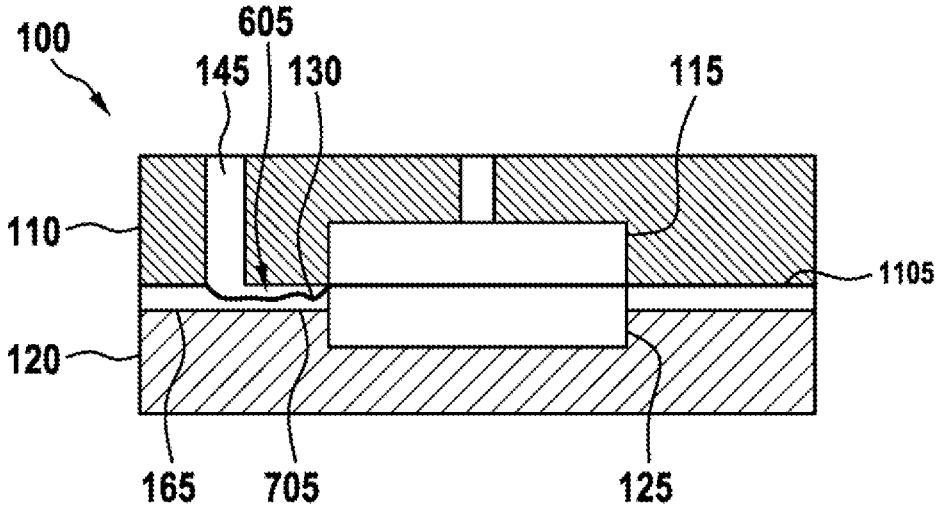
FIG. 10 shows a schematic representation of a microfluidic device for processing a liquid according to one exemplary embodiment.

FIG. 10 shows a schematic representation of a microfluidic device 100 for processing a liquid according to one exemplary embodiment. With the exception of the shaping of the hollow or the groove 705 in the fluidics substrate 120, the exemplary embodiment shown here corresponds to the exemplary embodiment shown in FIG. 7. Additionally, the microfluidic device 100 moreover comprises the fluidics capillary 165 for introducing the liquid into the fluidics space of the fluidics cavity 125, with a section of the fluidics capillary 165 that extends between the first pneumatics channel 145 and the fluidics cavity 125 simultaneously performing the function of the recess 705 here. Moreover, what is shown is a discharge channel 1005 for discharging the liquid out of the fluidics space of the fluidics cavity 125.

According to the exemplary embodiment shown here, the fluidics capillary 165 opens into the recess 705 or forms the recess 705, with fluidic separation of the first pneumatics channel 145, which is connected to the pneumatics capillary 605 formed by the deflection of the membrane 130, from the fluidics capillary 165 by the membrane 130. Thus, the hollow, in this case the recess 705, can, while the pneumatics capillary 605 is shaped, simultaneously also be used as a liquid-guiding channel in order to fill the fluidics cavity 125 with liquids. This embodiment advantageously allows a compact design. According to one exemplary embodiment, the flexible membrane 130 in the relaxed state extends along the cover of the recess 705 and the fluidics capillary 165. In the region of the fluidics capillary 165, the flexible membrane 130 is, according to one exemplary embodiment, attached to the pneumatics substrate 110. In the region of the recess 705, the flexible membrane 130 is, according to one exemplary embodiment, in detachable contact with the pneumatics substrate 110 in the relaxed state, meaning that a pressure medium introduced through the first pneumatics channel 145 can deflect the flexible membrane 130 into the recess 705 and thus arrive into the pneumatics cavity 115.

Figure 11:
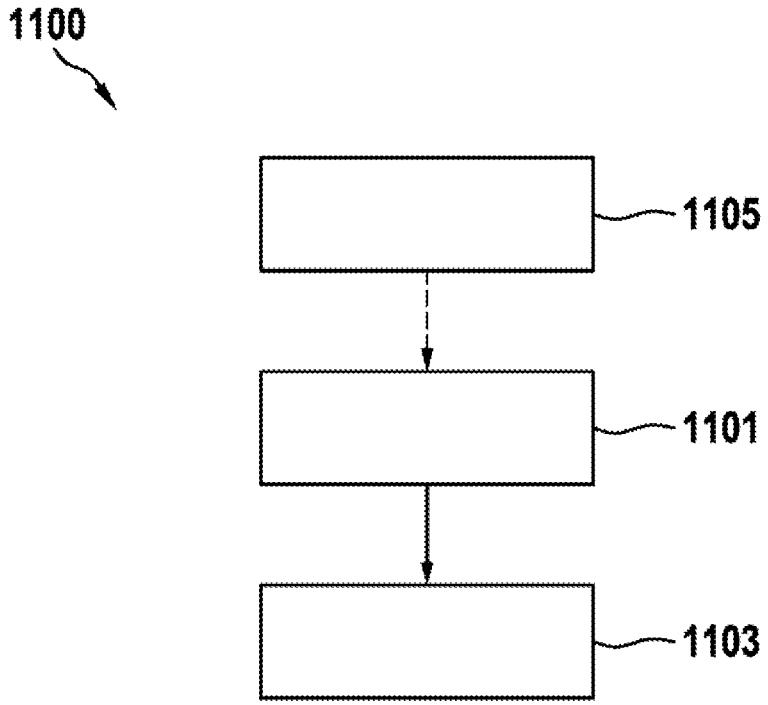
FIG. 11 shows a flowchart of a method for processing a liquid arranged in a fluidics space using a flexible membrane according to one exemplary embodiment.

FIG. 11 shows a flowchart of a method 1100 for processing a liquid arranged in a fluidics space using a flexible membrane according to one exemplary embodiment. Here, the membrane can be a membrane as described on the basis of the preceding figures. The membrane is designed to fluidically separate a fluidics space extending into a fluidics cavity at least in part and a pneumatics space extending into a pneumatics cavity at least in part from one another. The method 1100 comprises at least a step 1101 of applying a first pneumatic pressure to the pneumatics space and a step 1103 of applying a second pneumatic pressure to the pneumatics space, the second pneumatic pressure differing from the first pneumatic pressure in order to bring about an oscillation of the flexible membrane for processing of the liquid.

The method 1100 can moreover comprise a step 1105 of applying a negative pressure in relation to the pressure in the pneumatics cavity as the first pneumatic pressure to the pneumatics space and/or a negative pressure in relation to the pressure in the pneumatics cavity as the second pneumatic pressure to the pneumatics space in order to bring about an enlargement of the fluidics space by arching of the flexible membrane into the pneumatics cavity in order to introduce the liquid into the fluidics space. Step 1105 is optionally carried out before step 1101 and/or after step 1103.

According to one exemplary embodiment, step 1105 is carried out in order to introduce the liquid into the fluidics space, and this is followed by carrying out step 1101 and step 1103 in order to mix a liquid prestored in the fluidics space or a dry reagent prestored in the fluidics space with the liquid introduced in step 1105 by means of an oscillation of the flexible membrane. Subsequently, step 1105 is carried out again in order to maintain the enlargement of the fluidics space brought about by the arching of the flexible membrane or to effect it again.

According to a further exemplary embodiment, step 1105 is carried out in order to introduce the liquid into the fluidics space. Thereafter, step 1101 and step 1103 are carried out in order to generate turbulent flows in the liquid by means of the oscillation of the flexible membrane in order to reduce or avoid air-bubble formation in the liquid.

According to a further exemplary embodiment, step 1101 and step 1103 are also carried out in order to foam a liquid prestored in the fluidics space and having a low liquid volume and a comparatively high proportion of air or gas by means of an oscillation of the flexible membrane. In this case, step 1105 is carried out thereafter in order to effect the enlargement of the fluidics space by means of the arching of the flexible membrane in order to allow spreading of the foam generated.

If an exemplary embodiment comprises an "and/or" link between a first feature and a second feature, this should be read as meaning that the exemplary embodiment comprises both the first feature and the second feature according to one embodiment and either only the first feature or only the second feature according to a further embodiment.

The invention claimed is:

1. A microfluidic device for processing at least one liquid, the microfluidic device comprising:

a pneumatics substrate defining a pneumatics cavity;

a fluidics substrate defining a fluidics cavity configured to accommodate the at least one liquid, the fluidics cavity being arranged opposite to the pneumatics cavity;

a flexible membrane arranged between the pneumatics substrate and the fluidics substrate and configured to fluidically separate a fluidics space extending at least partially into the fluidics cavity and a pneumatics space extending at least partially into the pneumatics cavity from one another;

a first pneumatics channel configured to apply a first pneumatic pressure to the pneumatics space; and a second pneumatics channel configured to apply a second pneumatic pressure to the pneumatics space, wherein the first pneumatics channel and the second pneumatics channel both open into the pneumatics cavity.

2. The microfluidic device as claimed in claim 1, further comprising:

a cover arranged at an opposite side of the pneumatics cavity from the membrane, wherein at least one of the first pneumatics channel and the second pneumatics channel is guided through the cover.

3. The microfluidic device as claimed in claim 1, wherein the first pneumatics channel and the second pneumatics channel open into the pneumatics cavity on opposite sides of the pneumatics cavity.

4. The microfluidic device as claimed in claim 1, wherein at least one of the first pneumatics channel and the second pneumatics channel has a cross-sectional area of less than 0.5 $mm^2$.

5. The microfluidic device as claimed in claim 1, further comprising:

a fluidics capillary configured for introducing the at least one liquid into the fluidics space.

6. The microfluidic device as claimed in claim 1, wherein the first pneumatics channel comprises a pneumatics capillary that extends along and adjacent to the membrane and is configured for introducing the first pneumatic pressure into the pneumatics space.

7. The microfluidic device as claimed in claim 1, further comprising:

a pressure device coupled to the first pneumatics channel and the second pneumatics channel, the pressure device configured to apply the first pneumatic pressure to the first pneumatics channel and the second pneumatic pressure to the second pneumatics channel.

8. The microfluidic device as claimed in claim 7, wherein:

the pressure device is configured to apply a first negative pressure in relation to a pressure in the fluidics cavity as the first pneumatic pressure to the first pneumatics channel and to apply a second negative pressure in relation to the pressure in the fluidics cavity to the second pneumatics channel as the second pneumatic pressure, and the second negative pressure has a pressure level different from the first negative pressure so as to cause an oscillation of the membrane arched by the first and second negative pressures in a direction of the pneumatics cavity.

9. The microfluidic device as claimed in claim 7, wherein the pressure device is configured to apply a negative pressure in relation to a pressure in the pneumatics cavity as the first pneumatic pressure to the first pneumatics channel and/or to apply a negative pressure in relation to the pressure in the pneumatics cavity as the second pneumatic pressure to the second pneumatics channel so as to cause an enlargement of the fluidics space by arching of the flexible membrane into the pneumatics cavity in order to introduce the at least one liquid into the fluidics space.

10. The microfluidic device as claimed in claim 7, wherein:

the pressure device is configured to apply a first positive pressure in relation to a pressure in the fluidics cavity as the first pneumatic pressure to the first pneumatics channel and to apply a second positive pressure in relation to the pressure in the fluidics cavity as the second pneumatic pressure to the second pneumatics channel, and the second positive pressure has a pressure level different from the first positive pressure so as to cause an oscillation of the membrane arched by the first and second positive pressures in a direction of the fluidics cavity.

11. A method for processing at least one liquid using the microfluidic device as claimed in claim 1, the method comprising:

applying the first pneumatic pressure to the pneumatics space; and applying the second pneumatic pressure to the pneumatics space, the second pneumatic pressure differing from the first pneumatic pressure, such that the flexible membrane oscillates to process the at least one liquid.

12. The method as claimed in claim 11, further comprising:

applying at least one of (i) a first negative pressure in relation to a pressure in the pneumatics cavity as the first pneumatic pressure to the pneumatics space and (ii) a second negative pressure in relation to the pressure in the pneumatics cavity as the second pneumatic pressure to the pneumatics space so as to cause an enlargement of the fluidics space by arching of the flexible membrane into the pneumatics cavity to introduce at least one liquid into the fluidics space.

13. The microfluidic device as claimed in claim 1, wherein the second pneumatics channel opens centrally into the pneumatics cavity.

14. The microfluidic device as claimed in claim 7, wherein the pressure device including at least one pump configured to apply the first pneumatic pressure to the first pneumatics channel and the second pneumatic pressure to the second pneumatics channel.

* * * * *